United States Patent [19]

Ferguson

[11] Patent Number: 4,817,945

[45] Date of Patent: Apr. 4, 1989

[54] METHOD OF SCORING POCKET BILLIARD BOWLING

[76] Inventor: Larry G. Ferguson, 1606 Pipeline Rd., Summer Shade, Ky. 42166

[21] Appl. No.: 722,703

[22] Filed: Apr. 12, 1985

[51] Int. Cl.[4] ..... A63D 15/00

[52] U.S. Cl. ..... 273/2; 273/85 R

[58] Field of Search ..... 273/2, 3, 85 R

[56] References Cited

U.S. PATENT DOCUMENTS

| | | | |
|---|---|---|---|
| 1,164,791 | 12/1915 | Desenberg | 273/3 A |
| 1,971,295 | 8/1934 | Calaluca | 273/3 R |
| 4,687,208 | 8/1987 | Thomas | 273/2 |
| 4,784,388 | 11/1988 | Owen | 273/2 |

*Primary Examiner*—Richard C. Pinkham
*Assistant Examiner*—Brown, T.

[57] ABSTRACT

Pocket Billiard Bowling, a method of playing pocket billiards (pool) utilizing existent standard tournament size pocket billiard implements; table, cue, cue ball, and ten object balls numbered 1 through 10. the method of play enables the scoring to be similar to that of ten-pin bowling with a bonus system of runs and errant runs. Whereby, a player gets up to two attempts to run ten object balls per inning for nine innings and up to three attempts for a tenth and final inning with a maximum score of 300 for a game. The method of play also includes variations of the basic game which may be implemented to progressively increase the degree of difficulty for higher skilled players.

1 Claim, No Drawings

METHOD OF SCORING POCKET BILLIARD BOWLING

SUMMARY OF THE INVENTION

This invention pertains to an improvement in the process of playing pocket billiards (pool); in that, there is a new method of play using existing implements. The objective in creating the new method of play is to increase the interest and participation in playing pocket billiards, thereby increasing the commercial viability of the sport. I believe this invention of Pocket Billiard Bowling is an effective means of accomplishing this objective.

Pocket Billiard Bowling can be played by individuals, partners, or three to five player teams. The implements used are a standard tournament size pocket billiard table, cue, cue ball and ten object balls numbered one through ten. The method of play includes a basic game for lesser skilled players and variations which can be incorporated into the basic game to increase the degree of difficulty for higher skllled players. The method of play enables the scoring system to be similar to that used in the game of ten-pin bowling with bonuses for runs and errant runs instead of strikes and spares. Whereby, each player gets up to two attempts to run ten object balls per inning for nine innings and up to three attempts for a tenth and final inning with a maximum score of 300 for a game. The general rules of playing pocket billiards have been adapted and incorporated into the method of play, as well as the unique rules required for Pocket Billiard Bowling.

This invention of Pocket Billiard Bowling, if managed properly, is commercially feasible by having the potential throughout the world to accomplish the following:

(1) Provide new and maintain existing employment for many people.

(2) Provide competition and/or entertainment for millions of people by some actually competing and other spectating on site or through the media of television.

(3) Increase production and sales of existing implements.

(4) Generate the development, production and sales of new and/or improved implements (scorekeeping apparatuses, object balls, and triangle racks).

(5) Generate the remodeling and utilization of existing buildings and/or the building of new playing establishments.

(6) Become the one major sports event whereby men and women can fairly compete with or against each other.

DESCRIPTION OF DRAWINGS

There are no drawings.

DETAILED DESCRIPTION

Section 1. TERMINOLOGY

The following terms and their meanings are used in describing and playing the game of Pocket Billiard Bowling.

Attempt - An endeavor to pocket or run ten object balls before erring.

Bank Shot - (a) A shot in which an object ball is driven into a cushion in an endeavor to pocket it on the rebound. (b) A shot in which the cue ball is driven into a cushion to hit an object ball on the rebound in an endeavor to pocket it.

Bowling - The term bowling is used only in the title and is used mainly to reflect the method of play which combines a game of pocket billiards with a scoring system similar to that of ten-pin bowling. However, it is conceivable for the term to be suitable in describing pocket billiards, since both pocket billiards and ten-pin bowling, as well as other games, involve the rolling of an object across a flat surface to strike other objects.

Combination Shot - A shot in which an object ball is pocketed by causing another object ball to strike it.

Diamonds - Small discs of mother-of-pearl or plastic set into the raks 12.5. inches apart on a 4.5×9 feet pocket billiard table.

Errant Run (/) - An errant run is scored when a player pockets all ten object balls in two attempts of an inning.

Error - A miss, foul or scratch which are deviations from the objective or correct procedure.

Foot Rail - The rail at the end of the table where the object balls are racked.

Foot Spot - A point marked on the table's cloth two diamonds from and in the center of the foot rail that guides the racking and spotting of object balls.

Head String - An imaginary or actually drawn line running between the two center diamonds on the side rails at the head end of the pocket billiard table.

Inning - A turn of play at the pocket billiard table which consists of up to two attempts to pocket ten object balls.

Kiss Shot - A shot in which there is light contact or interference of one billiard ball with another, also called kiss-off.

Lagging - A method of determining who plays first or choice of two tables. The players simultaneously place a ball behind the head string and bank it off the foot rail. The player whose ball stops closest to the head rail wins and has the choice of tables or of playing first or second.

Long String - An imaginary or actually drawn line running from the foot spot to the center of the foot rail of the pocket billiard table that guides the spotting of object balls.

Run (X) - A run is scored when the player pockets all ten object balls on the first attempt of an inning.

Scratch - (a) When the cue ball is pocketed. (b) Competition based on actual scores rather than scores that include handicapping.

Section 2. THE GAME

Pocket Billiard Bowling is a game of pocket billiards designed to attract and maintain the interest of both the novice and the skillful. Pocket Billiard Bowling encompasses a basic game for amateurs with little or no skill to those with much higher skill, and variations of the basic game that increase the degree of difficulty for the experts or professionals. (See Section 14 for the variations.) The game can be played by anyone (young or old, short or tall, male or female) for fun, practice, or open competition not regulated by leagues or tournaments. However, it is better played in competitive leagues and/or tournaments by individuals, partners or 3 to 5 player teams with men and women competing against or with each other since neither sex has the advantage over the other. The only advantage any player has over another in a game of pocket billiards is his or her skill. (For a method of equalizing the competition between varying skill levels see the handicapping system in Section 13.)

Pocket Billiard Bowling is played on a standard tournament size rectangular pocket billiard table using regulation size cue, cue ball and 10 object balls numbered 1 through 10; also, a cue bridge when needed. The cue is used to strike the cue ball driving it into the object balls, thus attempting to drive them into the table's pockets. The 10 object balls are racked in a triangle at the foot spot. The 1 Ball is at the apex of the triangle on the foot spot. The 2 Ball is placed at the left apex of the triangle and the 3 Ball is placed at the right apex of the triangle. NOTE: When playing the basic game, there is no requirement for the ten object balls to be numbered. The balls could be a solid color (without numbers) and of a color that is the most contrastable with the green cloth of the table which should enhance the player's ability to see the periphery of an object ball. But, since object balls of this type are presently nonexistent and numbered balls do exist and will be required for variations of the basic game, the numbered balls will be used in describing all methods of play. So, bear in mind, when the numerical arrangement of balls are mentioned as in racking or spotting the balls, that compliance is not an absolute necessity when playing the basic game.

Pocket Billiard Bowling is strictly an offensive game with no opportunities for defensive play or deliberate safeties. There is no possibility of losing the game without getting a change to score due to each player getting ten turns at the table. The game is divided into ten innings of play for each player with players alternating turns at the table. A maximum of two errors are allowed for each inning (See Section 6. Errors), but when all (10) balls are pocketed with no more than one error the inning is concluded. In other words, the player gets up to two attempts to pocket 10 balls per inning.

Section 3. START OF PLAY

When the game is played on one table, lagging is used to determine which individual plays his or her first inning first. Winner may choose to have the opponent play first depending on how he or she wants to finish the game in the tenth inning. The first player to start is first to finish.

When the game is played on two tables, as in team play, lagging by the two team captains is used to determine which table his or her team starts on. The entire team plays their first innings on that table, then alternates between tables after each inning, with the team finishing the game in the tenth inning on the opposite table. For example, Team A starts on Table 2 and Team B starts on Table 1. After each player concludes their first inning play, the teams switch tables for the second inning and continues alternating between tables after each inning with Team A finishing the tenth inning on Table 1 and Team B on Table 2.

Section 4. THE BREAK

At the beginning of each inning, the player has the cue ball in hand (See Section 7). He or she breaks apart the rack of 10 object balls as fully as possible. In playing the basic game, the player is not required to contact the 1 Ball on the break. The cue ball can contact the rack of object balls at any point. If, while the player is breaking, the cue ball is pocketed or jumps the table, he or she again has the cue ball in hand and any pocketed object balls are spotted (See Section 8. Spotting Balls). There are no other penalties and the first attempt continues. If the break is legal (error free), the player has the option of continuing the first attempt from where the cue ball lies or having the cue ball in hand, regardless of whether any object balls were pocketed or not. However, if the choice is taking the cue ball in hand, any balls that were pocketed are spotted.

Section 5. CONTINUING PLAY

After the break, the player continues first and/or second attempt play by pocketing the remaining object balls at random (in no particular order).

Section 6. ERRORS

An error occurs when the player misses, scratches, or fouls. He or she is allowed up to two errors per inning. Penalty for an error is loss of an attempt in the inning. The first error of an inning ends the first attempt. (Exceptions may occur during the break. See Section 4.) The second error of the inning ends the second attempt, thereby, ending the inning. If the player is guilty of one or more errors on the same stroke, he or she is penalized only for one error and loses only one attempt. The following errors result in loss of an attempt to run the balls.

(a) Player misses by failing (after the break) to pocket an object ball. (A ball bouncing out of pocket and back on table is not considered pocketed, and remains in play from where it lies.)

(b) Player scratches (after the break) by pocketing the cue ball.

(c) Player cues (after the break) by forcing the cue ball off the table.

(d) Player fouls by striking the cue ball twice on same stroke.

(e) Player fouls by shooting while balls, including cue ball, are in motion or spinning.

(f) Player fouls by touching cue ball or object balls with cue, hands or any part of the body, clothing, etc., except with hands when cue ball is in hand or with the tip of cue on a legal stroke.

(g) Player fouls by failing to have one foot on the floor when stroking.

(h) Player fouls by failing to reposition the cue ball after having been warned by the opponent or referee that the ball is not within the head string.

(i) Player fouls by striking the cue ball below center with tip of cue during an endeavor to cause the cue ball to jump an object ball or balls in an effort to pocket another object ball.

Section 7. CUE BALL IN HAND

The player has the cue ball in hand on the break at the start of each inning, after a legal break if he or she so chooses (see Section 4), and if the cue ball is pocketed or forced off the table during the first attempt of each inning. When the cue ball is in hand, the player has the freedom to place the cue ball anywhere within the head string (between the head string and the head of the table) to shoot at an object ball not within the head string. The head string is a line (imaginary, or actually drawn on some tables) between the two center diamonds on the side tails at the head end of the table. The player must place the cue ball behind the head string with the bottom of the ball not touching the line. If the player fails to reposition the cue ball after having been warned by the opponent or reference that the ball is not within the head string, it is considered a foud and he or she loses that attempt in the inning. If it occurs during the break, it is a first attempt foul and the object ball are reracked for the player to break and start his or her second attempt. If the foul occurs during the second attempt, it ends the inning and pocketed object balls do not count.

Section 8. SPOTTING BALLS

Object balls that jump the table or that are pocketed illegally are spotted on the long string, running from the foot spot to the center of the foot rail. The balls are spotted in numerical order; for example, if the 1 and 3 Balls are illegally pocketed, the 1 Ball is placed on the foot spot and the 3 Ball is frozen behind it on the string. If the foot spot is occupied, the balls to be spotted are placed on the long string as close as possible to the spot, also in numerical order.

In no case is the cue ball or an object ball lying on the long string moved to make way for a ball to be spotted. Balls to be spotted are placed either in front of or behind such object balls on the long string. If the cue ball rests on the long string, the ball to be spotted is placed either in front of or behind the cue ball, as near as possible to the cue ball without it being frozen to the cue ball.

If the long string is totally occupied, the balls to be spotted are placed in front of the foot spot, as close as possible to the spot.

Section 9. OBJECT BALLS WITHIN HEAD STRING

If a player has the cue ball in hand and the legal object ball is within the head string (between the head string and the head of the table), the object ball is spotted on the foot spot. If there are two or more legal object balls within the head string, the one closest to the head string is spotted.

Section 10. INTERFERENCE

The player fouls if he or she disturbs the cue ball or object balls by touching with cue, hands or any part of body, clothing, etc., except when cue ball is in hand or as on a legal stroke with cue. (For penalty see Section 6.)

If non-player interferes with balls, while his or her opponent is in play, the offending player forfeits play in his or her next inning and receives a score of zero for that inning. If the interference occurs in the tenth inning and the offending player has already finished play, his or her tenth inning score is changed to zero with the cumulative score being refigured to reflect the change. (See the scoring system in Section 11.)

If balls are disturbed by any person or influence other than the players, conditions prior to distrubance are restored. Player at table continues his or her inning. If conditions are not restorable, the balls are racked and player replays the inning.

Section 11. SCORING

Scoring is based on the number of object balls pocketed per inning, plus a bonus system of runs and errant runs. A run is scored when the player pockets all (10) object balls on the first attempt. A run is worth 10 points plus the number of balls onn the next two attempts. An errant run is scored when the player pockets all (10) object balls in two attempts. An errant run is worth 10 points plus the number of balls pocketed on the next attempt.

The score is kept on a sheet of paper, blackboard or display scoreboard with ten blocks to a line for each player, similar to that used in ten-pin bowling, with enough room in each block to record the number of balls pocketed per error and/or errant run or run along with the cumulative score. The run mark is an X and the errant run mark is a diagonal line (/).

If the player pockets 5 balls and errs by scratching or forcing cue ball from table, second attempt play is continued with the cue ball in hand. If the player errs by missing or fouling, second attempt play is continued from where the cue ball lies. If on the second attempt, the player pockets only 3 of the remaining 5 balls before erring; then, the score for the inning is 8. However, if the player pockets the remaining 5 balls on the second attempt, an errant run is scored. This makes the score for that inning 10 plus the number of balls pocketed on the next attempt.

A run in the tenth or last inning gives the player two extra attempts; an errant run in the tenth inning gives him or her one extra attempt. A perfect score, achieved by runs in all ten innings including the two extra attempts at the end, is 300.

To clarify further the system of scoring, the principles are applied here to five sample innings.

| 1 | 2 | 3 | 4 | 5 | 6 | 7 | 8 | 9 | 10 |
|---|---|---|---|---|---|---|---|---|---|
| 3 4 | 4 / | X | X | 2 7 | | | | | |
| 7 | 27 | 49 | 68 | 77 | | | | | |

SCORING FOR 5 SAMPLE INNINGS

If, for example, in the first inning, the player pockets 3 balls before erring on the first attempt. The 3 balls are recorded in the first small squre of the first inning block. The player continues from where the cue ball lies and pockets 4 more balls before erring on this second and last attempt for the first inning. The 4 balls are recorded in the second small square. This terminates the play for the first inning with a cumulative score of 7 which is recorded in the large block.

In the second inning, the player pockets 4 balls on the first attempt and the remaining 6 on the second attempt. The 4 balls are recorded in the first small square and an errant run mark in the second small square. The cumulative score can not be recorded until the player completes the next attempt. The cumulative score will increase 10 plus the number of balls pocketed during the next attempt.

On the next attempt, the first of the third inning, the player pockets all the balls scoring a run which is recorded in the first square. So the cumulative score goes like this; 10 for the errant run, plus 10 balls on the next attempt equals 20; 20 plus the 7 in the first inning totals 27, which is recorded in the second inning block. In the fourth inning, the player pockets all the balls on the first attempt for another run. So the cumulative score for the third inning cannot be recorded until after the next attempt.

In the fifth inning, the player pockets only 2 balls during the first attempt and 7 during the second. So the 2 balls are recorded in the first small square and the 7 balls are recorded in the second square. The cumulative score for the third inning is recorded after the first attempt resulted in the pocketing of 2 balls. The player gets 10 for the run, plus the total from the next two attempts (10 more for the run in the fourth inning and 2 for the first attempt in the fifth), plus the 27 already in the second inning. This results in a cumulative score of 49 for the third inning. Now, the score for the fourth inning can be recorded by adding 10 for the run, plus 9 for the next two attempts to the 49 from the third inning. The score up to this point is 68. Since a total of only 9 was made in the fifth inning, this can be added at once to give 77 through the fifth inning. The five remaining innings of the game are scored and recorded in the same manner.

Records of each player's game scores should be maintained by the management of league and/or tournament play in order to provide an average score for each player. The averages can be used in handicapping (See Section 13) or by the players to determine their individual competitiveness.

Tie games should seldom occur; however, when played by many people in leagues and/or tournaments they may occasionally occur. Therefore, depending on the determination by the management of such organized play, the disposition of tie games may be as follows:

(a) Split the points, prizes or whatever with half going to each side, as may be the case for league play.

(b) Call the game a draw and replay the entire game, as may be the case for tournament or chamionship play.

Section 13. HANDICAP OR SCRATCH

Amateur leage and tournament play by teams can either be handicapped or scratch. The handicap system should be on a 75 percent basis, similar to that used in ten-pin bowling, where the average scores of the individuals on a team are added to total a team average. This team average will then be compared to an opposing team's average when they are in competition. For example, Team A's average is 650 and Team B's average is 750 which is a difference of 100. Therefore, Team A would receive a handicap of 75 which is 75 percent of the difference of 100. So, Team B would spot Team A 75 balls in their team score for the game.

Scratch competition has no handicapping; therefore, would result in comparing the actual total scores of the teams to determine the victor of the game.

Section 14. VARIATIONS OF PLAY

Realizing that, if everybody continued to play the basic game of Pocket Billiard Bowling, many would consistently score perfect games of 300. This should not be the case. Scores of 300 should be obtainable, but not common. Therefore, in keeping with the designed purpose of the game of Pocket Billiard Bowling to attract and maintain the interest of both the beginner and the expert which should produce many more and higher skilled experts, the following variations of the basic game may be implemented in any order or compatible combination to increase the degree of difficulty in playing the game.

(a) If, while the player is breaking, the cue ball is pocketed or forced off the table, it is considered an error and results in loss of an attempt to run the balls. If the error occurs on the first attempt, all pocketed object balls are spotted. (Implementation requires changes in Sec. 4 and Sec. 6, Items b and c.)

(b) Eliminate the player's option of having the cue ball in hand after a legal break with play being continued only from where the cue ball lies. (Implementation requires changes in Sec. 4 and Sec. 7.)

(c) All objects balls pocketed on the break are spotted before the player continues play whether he or she errs or not. (Implementation requires a change in Sec. 4.)

(d) If the player fails to pocket an object ball during the break, it is considered an error and results in loss of an attempt to run the balls. (Implementation requires changes in Sec. 4 and Sec. 6, Items a.)

(e) After the player breaks apart the object balls fully, the pocketed balls (if any) are spotted and play is continued as a call shot game. The player designates, to his or her opponent, (e) the object ball to be pocketed and the intended pocket. The player needs only to designate the ball and pocket not the kisses, combinations and banks, if any. Also, if additional object ball (balls other than the designated ball) are pocketed on the same stroke, they are considered legally pocketed. Failure to pocket the designated ball in the designated pocket is a miss and results in loss of an attempt to run the balls; additionally, if other object balls were pocketed on the stroke, they are considered illegal and do not count. The illegally pocketed balls are spotted only if the miss occurs during the first attempt of the inning. (Implementation requires changes in Sec. 4, Sec. 5 and Sec. 6, new item.)

(f) The ten object balls numbered 1 through 10 are pocketed in numerical order rather than in random order as in the basic game. The player must make the 1 Ball the first object ball. If he or she fails to contact the 1 Ball first on the break, it is an error and ends his or her first attempt play. All object balls pocketed on the errant break are spotted and second attempt play continues from where the cue ball lies with the 1 Ball being the legal object ball. The legal object ball is always the lowest-numbered ball on the table and the player must contact that ball first in pocketing it or before contacting and/or pocketing other balls by kiss and combination shots. In other words, if the player makes the cue ball contact the legal object ball (lowest-numbered ball) first, he or she is entitled to all object balls pocketed on that stroke, whether or not he or she pocketed the legal object ball. Failure to contact the legal object ball first (before contacting other balls) when making any shot is an error and results in loss of an attempt to run the balls. If that attempt is the first of an inning, other object balls pocketed on the stroke are spotted. (Implementation requires changes in Sec. 4, Sec. 5 and Sec. 6, new item.)

The ultimate game of skill for Pocket Billiard Bowling could possibly be formed by harmoniously combining the above variations (a), (e) and (f) and incorporating them into the basic game. However, additional variations, which would either decrease or increase the degree of difficulty, are possible and are considered to be within the scope of the game.

Section 15. STANDARDIZATION OF PLAY AND EQUIPMENT

Additional rules or regulations for Pocket Billiard Bowling may be levied by the management of league and/or tournament play. However, the regulation of implements or equipment utilized in player Pocket Billiard Bowling, as well as the rules of play, should be consistent or standardized. This is necessary in order to reinforce the main objective in designing the game, which is to attract and maintain the interest of many more people (nationally and internationally) than presently play pocket billiard games.

Standardization of play and equipment would permit a player of Pocket Billiard Bowling to compete anywhere in the world without having to learn new rules or to adjust to variances in the equipment. The rules for his or her level of play would be the same; the balls would be the same size, weight and color; the tables would be the same size with the same width of pockets; and, hopefully, the playing establishments would be similar. Standardization would allow a player to better concentrate on playing hiw or her best game or games for the competition; rather than, possibly being frustrated by determents like changes in rules, equipment or environment.

I claim:

1. In the method of playing pocket billiard bowling using a six pocket billiard table, a billiard cue, a cue ball, ten object balls, and means for displaying each player's score comprising a horizontal line for each player, ten blocks to each line, two small rectangles located in an upper corner of the first nine blocks of each line and three small rectangle located in the upper portion of the tenth block of each line, the steps comprising:

(a) beginning a first inning by racking the ten object balls on the table, a first player striking the cue ball with the cue to direct such ball at the rack of object balls and break the same, said first player striking the cue against the cue ball to hit one of the object balls and attempt to direct it into a pocket, repeating said attempt until said first player has pocketed the ten object balls or has committed two errors, each error comprising a miss, a scratch or a foul, scoring as in blowing by operating said means to indicate in the leftmost small rectangle the number of object balls pocketed before committing a first error, operating said means to indicate in the rightmost small rectangle the number of object balls pocketed after the first error and before committing a second error;

(b) after the first player has committed two errors or pocketed ten object balls prior to two errors, again racking the ten object balls on the table, a second player similarly striking the cue ball to break the racked balls and to attempt to direct the object balls into pockets, said second player repeating said attempt similar to said first player until said second player has committed two errors or has pocketed ten object balls before committing two errors, operating said means to indicate the number of object balls pocketed by said second player similar to the indication for the first player;

(c) commencing a second inning by said first player attempting to direct object balls into the pockets in the same manner as in said first inning, scoring as in bowling by operating said first player's display means to indicate in the two small rectangles of said second block the number of pocketed object balls in the same manner as in the first inning;

(d) scoring as in bowling by indicating in said first block of said first player the cumulative score for the first inning by adding the indications of the two small rectangles of the first block if less than ten balls had been pocketed by the time of the second error, displaying in said first block of said first player the cumulative score for the first inning by also adding the first small rectangle indication of said second block if ten object balls had been pocketed after the first error and before a second error in the first inning or adding both small rectangle indications of said second block if ten object balls had been pocketed before a first error in the first inning;

(e) completing the second inning by the second player attempting to pocket object balls and indicating that player's score in the first block and small rectangles of the second block in the same manner as the first player;

(f) repeating the above sequence of pocketing object balls and operating the display means through a total of ten innings;

(g) for the tenth inning, each player making a first additional attempt to pocket ten object balls if that player had succeeded, for that inning, in pocketing ten object balls before two errors had been made;

(h) for the tenth inning, each player making a second additional attempt to pocket ten object balls if that player had succeeded, for that inning, in pocketing ten object balls before one error had been made; and (i) scoring by indicating in the leftmost small rectangle of each player's tenth block the number of object balls pocketed before committing a first error in the tenth inning, indicating in the middle small rectangle of each player's tenth block the number of object balls pocketed after the first error and before committing a second error or the number of object balls pocketed in that player's first additional attempt of the tenth inning if ten object balls had been pocketed before committing a first error, indicating in the rightmost small rectangle the number of object balls pocketed in that player's first additional attempt of the tenth inning if ten object balls had been pocketed before committing a second error or the number of object balls pocketed in that player's second additional attempt of the tenth inning if ten object balls had been pocketed before committing a first error, and indicating in each player's tenth block that player's cumulative score for the game by adding all of that player's tenth block small rectangle indications to the cumulative score indication in that player's ninth block.

* * * * *

UNITED STATES PATENT AND TRADEMARK OFFICE

CERTIFICATE OF CORRECTION

PATENT NO. : 4,817,945

DATED : April 4, 1989

INVENTOR(S) : Larry G. Ferguson

It is certified that error appears in the above-identified patent and that said Letters Patent is hereby corrected as shown below:

The title page should be deleted to appear as per attached title page.

Columns 1 through 10 should be deleted to appear as per attached columns 1 through 10.

Signed and Sealed this

Twenty-fifth Day of July, 1989

*Attest:*

DONALD J. QUIGG

*Attesting Officer*

*Commissioner of Patents and Trademarks*

United States Patent [19]

Ferguson

[11] Patent Number: 4,817,945

[45] Date of Patent: Apr. 4, 1989

[54] METHOD OF PLAYING AND SCORING POCKET BILLIARD BOWLING

[76] Inventor: Larry G. Ferguson, 1606 Pipeline Rd., Summer Shade, Ky. 42166

[21] Appl. No.: 722,703

[22] Filed: Apr. 12, 1985

[51] Int. Cl.[4] ..... A63D 15/00

[52] U.S. Cl. ..... 273/2; 273/85 R

[58] Field of Search ..... 273/2, 3, 85 R

[56] References Cited

U.S. PATENT DOCUMENTS

| | | | |
|---|---|---|---|
| 1,164,791 | 12/1915 | Desenberg | 273/3 A |
| 1,971,295 | 8/1934 | Calaluca | 273/3 R |
| 4,687,208 | 8/1987 | Thomas | 273/2 |
| 4,784,388 | 11/1988 | Owen | 273/2 |

*Primary Examiner*—Richard C. Pinkham
*Assistant Examiner*—Brown, T.

[57] ABSTRACT

Pocket Billiard Bowling, a method of playing pocket billiards (pool) utilizing existent standard tournament size pocket billiard implements; table, cue, cue ball, and ten object balls numbered 1 through 10. The method of play enables the scoring to be similar to that of ten-pin bowling with a bonus system of runs and errant runs. Whereby, a player gets up to two attempts to run ten object balls per inning for nine innings and up to three attempts for a tenth and final inning with a maximum score of 300 for a game. The method of play also includes variations of the basic game which may be implemented to progressively increase the degree of difficulty for higher skilled players.

1 Claim, No Drawings

METHOD OF PLAYING AND SCORING POCKET BILLIARD BOWLING

SUMMARY OF THE INVENTION

This invention pertains to an improvement in the process of playing pocket billiards (pool); in that, there is a new method of play using existing implements. The objective in creating the new method of play is to increase the interest and participation in playing pocket billiards, thereby increasing the commercial viability of the sport. I believe this invention of Pocket Billiard Bowling is an effective means of accomplishing this objective.

Pocket Billiard Bowling can be played by individuals, partners, or three to five player teams. The implements used are a standard tournament size pocket billiard table, cue, cue ball and ten object balls numbered one through ten. The method of play includes a basic game for lesser skilled players and variations which can be incorporated into the basic game to increase the degree of difficulty for higher skilled players. The method of play enables the scoring system to be similar to that used in the game of ten-pin bowling with bonuses for runs and errant runs instead of strikes and spares. Whereby, each player gets up to two attempts to run ten object balls per inning for nine innings and up to three attempts for a tenth and final inning with a maximum score of 300 for a game. The general rules of playing pocket billiards have been adapted and incorporated into the method of play, as well as the unique rules required for Pocket Billiard Bowling.

This invention of Pocket Billiard Bowling, if managed properly, is commercially feasible by having the potential throughout the world to accomplish the following:

(1) Provide new and maintain existing employment for many people.

(2) Provide competition and/or entertainment for millions of people by some actually competing and others spectating on site or through the media of television.

(3) Increase production and sales of existing implements.

(4) Generate the development, production and sales of new and/or improved implements (scorekeeping apparatuses, object balls, and triangle racks).

(5) Generate the remodeling and utilization of existing buildings and/or the building of new playing establishments.

(6) Become the one major sports event whereby men and women can fairly compete with or against each other.

DESCRIPTION OF DRAWINGS

There are no drawings.

DETAILED DESCRIPTION

Section 1. TERMINOLOGY

The following terms and their meanings are used in describing and playing the game of Pocket Billiard Bowling.

Attempt - An endeavor to pocket or run ten object balls before erring.

Bank Shot - (a) A shot in which an object ball is driven into a cushion in an endeavor to pocket it on the rebound. (b) A shot in which the cue ball is driven into a cushion to hit an object ball on the rebound in an endeavor to pocket it.

Bowling - The term bowling is used only in the title and is used mainly to reflect the method of play which combines a game of pocket billiards with a scoring system similar to that of ten-pin bowling. However, it is conceivable for the term to be suitable in describing pocket billiards, since both pocket billiards and ten-pin bowling, as well as other games, involve the rolling of an object across a flat surface to strike other objects.

Combination Shot - A shot in which an object ball is pocketed by causing another object ball to strike it.

Diamonds - Small discs of mother-of-pearl or plastic set into the rails 12.5 inches apart on a 4.5×9 feet pocket billiard table.

Errant Run (/) - An errant run is scored when a player pockets all ten object balls in two attempts of an inning.

Error - A miss, foul or scratch which are deviations from the objective or correct procedure.

Foot Rail - The rail at the end of the table where the object balls are racked.

Foot Spot - A point marked on the table's cloth two diamonds from and in the center of the foot rail that guides the racking and spotting of object balls.

Head String - An imaginary or actually drawn line running between the two center diamonds on the side rails at the head end of the pocket billiard table.

Inning - A turn of play at the pocket billiard table which consists of up to two attempts to pocket ten object balls.

Kiss Shot - A shot in which there is light contact or interference of one billiard ball with another, also called kiss-off.

Lagging - A method of determining who plays first or choice of two tables. The players simultaneously place a ball behind the head string and bank it off the foot rail. The player whose ball stops closest to the head rail wins and has the choice of tables or of playing first or second.

Long String - An imaginary or actually drawn line running from the foot spot to the center of the foot rail of the pocket billiard table that guides the spotting of object balls.

Run (X) - A run is scored when the player pockets all ten object balls on the first attempt of an inning.

Scratch - (a) When the cue ball is pocketed. (b) Competition based on actual scores rather than scores that include handicapping.

Section 2. THE GAME

Pocket Billiard Bowling is a game of pocket billiards designed to attract and maintain the interest of both the novice and the skillful. Pocket Billiard Bowling encompasses a basic game for amateurs with little or no skill to those with much higher skill, and variations of the basic game that increase the degree of difficulty for the experts or professionals. (See Section 14 for the variations.) The game can be played by anyone (young or old, short or tall, male or female) for fun, practice, or open competition not regulated by leagues or tournaments. However, it is better played in competitive leagues and/or tournaments by individuals, partners or 3 to 5 player teams with men and women competing against or with each other since neither sex has the advantage over the other. The only advantage any player has over another in a game of pocket billiards is his or her skill. (For a method of equalizing the competition between varying skill levels see the handicapping system in Section 13.)

Pocket Billiard Bowling is played on a standard tournament size rectangular pocket billiard table using regulation size cue, cue ball and 10 object balls numbered 1 through 10; also, a cue bridge when needed. The cue is used to strike the cue ball driving it into the object balls, thus attempting to drive them into the table's pockets. The 10 object balls are racked in a triangle at the foot spot. The 1 Ball is at the apex of the triangle on the foot spot. The 2 Ball is placed at the left apex of the triangle and the 3 Ball is placed at the right apex of the triangle. NOTE: When playing the basic game, there is no requirement for the ten object balls to be numbered. The balls could be a solid color (without numbers) and of a color that is the most contrastable with the green cloth of the table which should enhance the player's ability to see the periphery of an object ball. But, since object balls of this type are presently nonexistent and numbered balls do exist and will be required for variations of the basic game, the numbered balls will be used in describing all methods of play. So, bear in mind, when the numerical arrangement of balls are mentioned as in racking or spotting the balls, that compliance is not an absolute necessity when playing the basic game.

Pocket Billiard Bowling is strictly an offensive game with no opportunities for defensive play or deliberate safeties. There is no possibility of losing the game without getting a chance to score due to each player getting ten turns at the table. The game is divided into ten innings of play for each player with players alternating turns at the table. A maximum of two errors are allowed for each inning (See Section 6. Errors), but when all (10) balls are pocketed with no more than one error the inning is concluded. In other words, the player gets up to two attempts to pocket 10 balls per inning.

Section 3. START OF PLAY

When the game is played on one table, lagging is used to determine which individual plays his or her first inning first. Winner may choose to have the opponent play first depending on how he or she wants to finish the game in the tenth inning. The first player to start is first to finish.

When the game is played on two tables, as in team play, lagging by the two team captains is used to determine which table his or her team starts on. The entire team plays their first innings on that table, then alternates between tables after each inning, with the team finishing the game in the tenth inning on the opposite table. For example, Team A starts on Table 2 and Team B starts on Table 1. After each player concludes their first inning play, the teams switch tables for the second inning and continue alternating between tables after each inning with Team A finishing the tenth inning on Table 1 and Team B on Table 2.

Section 4. THE BREAK

At the beginning of each inning, the player has the cue ball in hand (See Section 7). He or she breaks apart the rack of 10 object balls as fully as possible. In playing the basic game, the player is not required to contact the 1 Ball on the break. The cue ball can contact the rack of object balls at any point. If, while the player is breaking, the cue ball is pocketed or jumps the table, he or she again has the cue ball in hand and any pocketed object balls are spotted (See Section 8. Spotting Balls). There are no other penalties and the first attempt continues. If the break is legal (error free), the player has the option of continuing the first attempt from where the cue ball lies or having the cue ball in hand, regardless of whether any object balls were pocketed or not. However, if the choice is taking the cue ball in hand, any balls that were pocketed are spotted.

Section 5. CONTINUING PLAY

After the break, the player continues first and/or second attempt play by pocketing the remaining object balls at random (in no particular order).

Section 6. ERRORS

An error occurs when the player misses, scratches, or fouls. He or she is allowed up to two errors per inning. Penalty for an error is loss of an attempt in the inning. The first error of an inning ends the first attempt. (Exceptions may occur during the break. See Section 4.) The second error of the inning ends the second attempt, thereby, ending the inning. If the player is guilty of one or more errors on the same stroke, he or she is penalized only for one error and loses only one attempt. The following errors result in loss of an attempt to run the balls.

(a) Player misses by failing (after the break) to pocket an object ball. (A ball bouncing out of pocket and back on table is not considered pocketed, and remains in play from where it lies.)

(b) Player scratches (after the break) by pocketing the cue ball.

(c) Player fouls (after the break) by forcing the cue ball off the table.

(d) Player fouls by striking the cue ball twice on same stroke.

(e) Player fouls by shooting while balls, including cue ball, are in motion or spinning.

(f) Player fouls by touching cue ball or object balls with cue, hands or any part of the body, clothing, etc., except with hands when cue ball is in hand or with the tip of cue on a legal stroke.

(g) Player fouls by failing to have one foot on the floor when stroking.

(h) Player fouls by failing to reposition the cue ball after having been warned by the opponent or referee that the ball is not within the head string.

(i) Player fouls by striking the cue ball below center with tip of cue during an endeavor to cause the cue ball to jump an object ball or balls in an effort to pocket another object ball.

Section 7. CUE BALL IN HAND

The player has the cue ball in hand on the break at the start of each inning, after a legal break if he or she so chooses (see Section 4), and if the cue ball is pocketed or forced off the table during the first attempt of each inning. When the cue ball is in hand, the player has the freedom to place the cue ball anywhere within the head string (between the head string and the head of the table) to shoot at an object ball not within the head string. The head string is a line (imaginary, or actually drawn on some tables) between the two center diamonds on the side rails at the head end of the table. The player must place the cue ball behind the head string with the bottom of the ball not touching the line. If the player fails to reposition the cue ball after having been warned by the opponent or referee that the ball is not within the head string, it is considered a foul and he or she loses that attempt in the inning. If it occurs during the break, it is a first attempt foul and the object balls are reracked for the player to break and start his or her second attempt. If the foul occurs during the second attempt, it ends the inning and pocketed object balls do not count.

Section 8. SPOTTING BALLS

Object balls that jump the table or that are pocketed illegally are spotted on the long string, running from the foot spot to the center of the foot rail. The balls are spotted in numerical order; for example, if the 1 and 3 Balls are illegally pocketed, the 1 Ball is placed on the foot spot and the 3 Ball is frozen behind it on the string. If the foot spot is occupied, the balls to be spotted are placed on the long string as close as possible to the spot, also in numerical order.

In no case is the cue ball or an object ball lying on the long string moved to make way for a ball to be spotted. Balls to be spotted are placed either in front of or behind such object balls on the long string. If the cue ball rests on the long string, the ball to be spotted is placed either in front of or behind the cue ball, as near as possible to the cue ball without it being frozen to the cue ball.

If the long string is totally occupied, the balls to be spotted are placed in front of the foot spot, as close as possible to the spot.

Section 9. OBJECT BALLS WITHIN HEAD STRING

If a player has the cue ball in hand and the legal object ball is within the head string (between the head string and the head of the table), the object ball is spotted on the foot spot. If there are two or more legal object balls within the head string, the one closest to the head string is spotted.

Section 10. INTERFERENCE

The player fouls if he or she disturbs the cue ball or object balls by touching with cue, hands or any part of body, clothing, etc., except when cue ball is in hand or as on a legal stroke with cue. (For penalty see Section 6.)

If non-player interferes with balls, while his or her opponent is in play, the offending player forfeits play in his or her next inning and receives a score of zero for that inning. If the interference occurs in the tenth inning and the offending player has already finished play, his or her tenth inning score is changed to zero with the cumulative score being refigured to reflect the change. (See the scoring system in Section 11.)

If balls are disturbed by any person or influence other than the players, conditions prior to disturbance are restored. Player at table continues his or her inning. If conditions are not restorable, the balls are racked and player replays the inning.

Section 11. SCORING

Scoring is based on the number of object balls pocketed per inning, plus a bonus system of runs and errant runs. A run is scored when the player pockets all (10) object balls on the first attempt. A run is worth 10 points plus the number of balls pocketed on the next two attempts. An errant run is scored when the player pockets all (10) object balls in two attempts. An errant run is worth 10 points plus the number of balls pocketed on the next attempt.

The score is kept on a sheet of paper, blackboard or display scoreboard with ten blocks to a line for each player, similar to that used in ten-pin bowling, with enough room in each block to record the number of balls pocketed per error and/or errant run or run along with the cumulative score. The run mark is an X and the errant run mark is a diagonal line (/).

If the player pockets 5 balls and errs by scratching or forcing cue ball from table, second attempt play is continued with the cue ball in hand. If the player errs by missing or fouling, second attempt play is continued from where the cue ball lies. If on the second attempt, the player pockets only 3 of the remaining 5 balls before erring; then, the score for the inning is 8. However, if the player pockets the remaining 5 balls on the second attempt, an errant run is scored. This makes the score for that inning 10 plus the number of balls pocketed on the next attempt.

A run in the tenth or last inning gives the player two extra attempts; an errant run in the tenth inning gives him or her one extra attempt. A perfect score, achieved by runs in all ten innings including the two extra attempts at the end, is 300.

To clarify further the system of scoring, the principles are applied here to five sample innings.

| 1 | 2 | 3 | 4 | 5 | 6 | 7 | 8 | 9 | 10 |
|---|---|---|---|---|---|---|---|---|---|
| 3 4 | 4 / | X | X | 2 7 | | | | | |
| 7 | 27 | 49 | 68 | 77 | | | | | |

SCORING FOR 5 SAMPLE INNINGS

If, for example, in the first inning, the player pockets 3 balls before erring on the first attempt. The 3 balls are recorded in the first small square of the first inning block. The player continues from where the cue ball lies and pockets 4 more balls before erring on this second and last attempt for the first inning. The 4 balls are recorded in the second small square. This terminates the play for the first inning with a cumulative score of 7 which is recorded in the large block.

In the second inning, the player pockets 4 balls on the first attempt and the remaining 6 on the second attempt. The 4 balls are recorded in the first small square and an errant run mark in the second small square. The cumulative score can not be recorded until the player completes the next attempt. The cumulative score will increase 10 plus the number of balls pocketed during the next attempt.

On the next attempt, the first of the third inning, the player pockets all the balls scoring a run which is recorded in the first square. So the cumulative score goes like this; 10 for the errant run, plus 10 balls on the next attempt equals 20; 20 plus the 7 in the first inning totals 27, which is recorded in the second inning block. In the fourth inning, the player pockets all the balls on the first attempt for another run. So the cumulative score for the third inning cannot be recorded until after the next attempt.

In the fifth inning, the player pockets only 2 balls during the first attempt and 7 during the second. So the 2 balls are recorded in the first small square and the 7 balls are recorded in the second square. The cumulative score for the third inning is recorded after the first attempt resulted in the pocketing of 2 balls. The player gets 10 for the run, plus the total from the next two attempts (10 more for the run in the fourth inning and 2 for the first attempt in the fifth), plus the 27 already in the second inning. This results in a cumulative score of 49 for the third inning. Now, the score for the fourth inning can be recorded by adding 10 for the run, plus 9 for the next two attempts to the 49 from the third inning. The score up to this point is 68. Since a total of only 9 was made in the fifth inning, this can be added at once to give 77 through the fifth inning. The five remaining innings of the game are scored and recorded in the same manner.

Records of each player's game scores should be maintained by the management of league and/or tournament play in order to provide an average score for each player. The averages can be used in handicapping (See Section 13) or by the players to determine their individual competitiveness.

Section 12. TIE GAMES

Tie games should seldom occur; however, when played by many people in leagues and/or tournaments they may occasionally occur. Therefore, depending on the determination by the management of such organized play, the disposition of tie games may be as follows:

(a) Split the points, prizes or whatever with half going to each side, as may be the case for league play.

(b) Call the game a draw and replay the entire game, as may be the case for tournament or championship play.

Section 13. HANDICAP OR SCRATCH

Amateur league and tournament play by teams can either be handicapped or scratch. The handicap system should be on a 75 percent basis, similar to that used in ten-pin bowling, where the average scores of the individuals on a team are added to total a team average. This team average will then be compared to an opposing team's average when they are in competition. For example, Team A's average is 650 and Team B's average is 750 which is a difference of 100. Therefore, Team A would receive a handicap of 75 which is 75 percent of the difference of 100. So, Team B would spot Team A 75 balls in their team score for the game.

Scratch competition has no handicapping; therefore, would result in comparing the actual total scores of the teams to determine the victor of the game.

Section 14. VARIATIONS OF PLAY

Realizing that, if everybody continued to play the basic game of Pocket Billiard Bowling, many would consistently score perfect games of 300. This should not be the case. Scores of 300 should be obtainable, but not common. Therefore, in keeping with the designed purpose of the game of Pocket Billiard Bowling to attract and maintain the interest of both the beginner and the expert which should produce many more and higher skilled experts, the following variations of the basic game may be implemented in any order or compatible combination to increase the degree of difficulty in playing the game.

(a) If, while the player is breaking, the cue ball is pocketed or forced off the table, it is considered an error and results in loss of an attempt to run the balls. If the error occurs on the first attempt, all pocketed object balls are spotted. (Implementation requires changes in Sec. 4 and Sec. 6, Items b and c.)

(b) Eliminate the player's option of having the cue ball in hand after a legal break with play being continued only from where the cue ball lies. (Implementation requires changes in Sec. 4 and Sec. 7.)

(c) All objects balls pocketed on the break are spotted before the player continues play whether he or she errs or not. (Implementation requires a change in Sec. 4.)

(d) If the player fails to pocket an object ball during the break, it is considered an error and results in loss of an attempt to run the balls. (Implementation requires changes in Sec. 4 and Sec. 6, Item a.)

(e) After the player breaks apart the object balls fully, the pocketed balls (if any) are spotted and play is continued as a call shot game. The player designates, to his or her opponent, the object ball to be pocketed and the intended pocket. The player needs only to designate the ball and pocket not the kisses, combinations and banks, if any. Also, if additional object balls (balls other than the designated ball) are pocketed on the same stroke, they are considered legally pocketed. Failure to pocket the designated ball in the designated pocket is a miss and results in loss of an attempt to run the balls; additionally, if other object balls were pocketed on the stroke, they are considered illegal and do not count. The illegally pocketed balls are spotted only if the miss occurs during the first attempt of the inning. (Implementation requires changes in Sec. 4, Sec. 5 and Sec. 6, new item.)

(f) The ten object balls numbered 1 through 10 are pocketed in numerical order rather than in random order as in the basic game. The player must make the 1 Ball the first object ball. If he or she fails to contact the 1 Ball first on the break, it is an error and ends his or her first attempt play. All object balls pocketed on the errant break are spotted and second attempt play continues from where the cue ball lies with the 1 Ball being the legal object ball. The legal object ball is always the lowest-numbered ball on the table and the player must contact that ball first in pocketing it or before contacting and/or pocketing other balls by kiss and combination shots. In other words, if the player makes the cue ball contact the legal object ball (lowest-numbered ball) first, he or she is entitled to all object balls pocketed on that stroke, whether or not he or she pocketed the legal object ball. Failure to contact the legal object ball first (before contacting other balls) when making any shot is an error and results in loss of an attempt to run the balls. If that attempt is the first of an inning, other object balls pocketed on the stroke are spotted. (Implementation requires changes in Sec. 4, Sec. 5 and Sec. 6, new item.)

The ultimate game of skill for Pocket Billiard Bowling could possibly be formed by harmoniously combining the above variations (a), (e) and (f) and incorporating them into the basic game. However, additional variations, which would either decrease or increase the degree of difficulty, are possible and are considered to be within the scope of the game.

Section 15. STANDARDIZATION OF PLAY AND EQUIPMENT

Additional rules or regulations for Pocket Billiard Bowling may be levied by the management of league and/or tournament play. However, the regulation of implements or equipment utilized in playing Pocket Billiard Bowling, as well as the rules of play, should be consistent or standardized. This is necessary in order to reinforce the main objective in designing the game, which is to attract and maintain the interest of many more people (nationally and internationally) than presently play pocket billiard games.

Standardization of play and equipment would permit a player of Pocket Billiard Bowling to compete anywhere in the world without having to learn new rules or to adjust to variances in the equipment. The rules for his or her level of play would be the same; the balls would be the same size, weight and color; the tables would be the same size with the same width of pockets; and, hopefully, the playing establishments would be similar. Standardization would allow a player to better concentrate on playing his or her best game or games for the competition; rather than, possibly being frustrated by determents like changes in rules, equipment or environment.

I claim:

1. In the method of playing pocket billiard bowling using a six pocket billiard table, a billiard cue, a cue ball, ten object balls, and means for displaying each player's score comprising a horizontal line for each player, ten blocks to each line, two small rectangles located in an upper corner of the first nine blocks of each line and three small rectangles located in the upper portion of the tenth block of each line, the steps comprising:

(a) beginning a first inning by racking the ten object balls on the table, a first player striking the cue ball with the cue to direct such ball at the rack of object balls and break the same, said first player striking the cue against the cue ball to hit one of the object balls and attempt to direct it into a pocket, repeating said attempt until said first player has pocketed the ten object balls or has committed two errors, each error comprising a miss, a scratch or a foul, scoring as in bowling by operating said means to indicate in the leftmost small rectangle the number of object balls pocketed before committing a first error, operating said means to indicate in the rightmost small rectangle the number of object balls pocketed after the first error and before committing a second error;

(b) after the first player has committed two errors or pocketed ten object balls prior to two errors, again racking the ten object balls on the table, a second player similarly striking the cue ball to break the racked balls and to attempt to direct the object balls into pockets, said second player repeating said attempt similar to said first player until said second player has committed two errors or has pocketed ten object balls before committing two errors, operating said means to indicate the number of object balls pocketed by said second player similar to the indication for the first player;

(c) commencing a second inning by said first player attempting to direct object balls into the pockets in the same manner as in said first inning, scoring as in bowling by operating said first player's display means to indicate in the two small rectangles of said second block the number of pocketed object balls in the same manner as in the first inning;

(d) scoring as in bowling by indicating in said first block of said first player the cumulative score for the first inning by adding the indications of the two small rectangles of the first block if less than ten balls had been pocketed by the time of the second error, displaying in said first block of said first player the cumulative score for the first inning by also adding the first small rectangle indication of said second block if ten object balls had been pocketed after the first error and before a second error in the first inning or adding both small rectangle indications of said second block if ten object balls had been pocketed before a first error in the first inning;

(e) completing the second inning by the second player attempting to pocket object balls and indicating that player's score in the first block and small rectangles of the second block in the same manner as the first player;

(f) repeating the above sequence of pocketing object balls and operating the display means through a total of ten innings;

(g) for the tenth inning, each player making a first additional attempt to pocket ten object balls if that player had succeeded, for that inning, in pocketing ten object balls before two errors had been made;

(h) for the tenth inning, each player making a second additional attempt to pocket ten object balls if that player had succeeded, for that inning, in pocketing ten object balls before one error had been made; and (i) scoring by indicating in the leftmost small rectangle of each player's tenth block the number of object balls pocketed before committing a first error in the tenth inning, indicating in the middle small rectangle of each player's tenth block the number of object balls pocketed after the first error and before committing a second error or the number of object balls pocketed in that player's first additional attempt of the tenth inning if ten object balls had been pocketed before committing a first error, indicating in the rightmost small rectangle the number of object balls pocketed in that player's first additional attempt of the tenth inning if ten object balls had been pocketed before committing a second error or the number of object balls pocketed in that player's second additional attempt of the tenth inning if ten object balls had been pocketed before committing a first error, and indicating in each player's tenth block that player's cumulative score for the game by adding all of that player's tenth block small rectangle indications to the cumulative score indication in that player's ninth block.

* * * * *